United States Patent [19]

Strangward

[11] Patent Number: 4,486,040

[45] Date of Patent: Dec. 4, 1984

[54] SLIDE LATCH ASSEMBLY FOR A CASKET

[75] Inventor: William J. Strangward, Rocky River, Ohio

[73] Assignee: The Langenau Manufacturing Company, Cleveland, Ohio

[21] Appl. No.: 195,378

[22] Filed: Oct. 9, 1980

[51] Int. Cl.[3] ..... E05C 1/06

[52] U.S. Cl. ..... 292/160; 292/DIG. 53

[58] Field of Search ..... 292/156, 160, DIG. 53, 292/142, 157, 162

[56] References Cited

U.S. PATENT DOCUMENTS

| | | | |
|---|---|---|---|
| 1,527,572 | 2/1925 | Olson | 292/156 X |
| 2,587,355 | 2/1952 | McEwan | 292/157 X |
| 2,821,770 | 2/1958 | Gruber | 292/160 X |
| 2,864,640 | 12/1958 | Mattinson | 292/158 X |
| 4,142,747 | 3/1979 | Beck et al. | 292/DIG. 53 X |

*Primary Examiner*—Richard E. Moore

*Attorney, Agent, or Firm*—Pearne, Gordon, Sessions, McCoy, Granger & Tilberry

[57] ABSTRACT

An improved slide latch assembly for a casket is disclosed on the type having a longitudinally elongated base and a slide bar which extends along and perpendicularly to the base and is capable of longitudinal movement to engage and retain escutcheons. In place of the separately formed and attached channel members of the prior art, the present invention may provide U-shaped restraining guide members which are integrally formed from the base by being stamped therefrom and bent to extend perpendicularly from the base. In addition, the invention may provide differently shaped securing portions on the slide bar so that some of the escutcheons are first engaged before the slide bar is moved further to engage the remainder of the escutcheons.

9 Claims, 9 Drawing Figures

SLIDE LATCH ASSEMBLY FOR A CASKET

BACKGROUND OF THE INVENTION

1. Field of the Invention

This invention relates to casket hardware and particularly to a slide latch assembly for a casket which is used to secure and seal the top of the casket to the bottom portion.

2. Description of the Prior Art

Items of casket hardware generally include a slide latch assembly which is mounted in the bottom portion of the casket beneath the rim on the side opposite the hinge. The slide latch assembly receives apertured securing pins or escutcheons from the casket top and includes a slide bar having wedge-shaped securing portions which engage the apertures of the escutcheons to secure the top when the casket is closed. The slide latch assembly also includes a socket attachment for a crank which is used to move the slide bar and secure the casket top.

The conventional design of slide latch assemblies has included a top supporting base which was mounted beneath the rim of the casket bottom portion and a slide bar extending beneath the base and supported by a plurality of separate hangers or channel members which were fabricated of a sheet metal material and welded, brazed, or otherwise attached to the base. The slide bar had identical wedge-shaped securing portions each adapted to secure an escutcheon. In accordance with conventional design of slide latch assemblies adapted to receive two escutcheons, two channel members were provided, one at each end of the slide bar. Additional channel members were provided for longer slide latch assemblies adapted to receive four escutcheons. Each of the channel members comprised a piece of sheet metal material which was bent to form a restraining channel within which the slide bar was supported so that it was capable of longitudinal movement. The channel members were each positioned beneath the slide bar, and one or both ends of the channel member were then attached to the base. An additional support member was also provided for center crank assemblies at approximately the middle of the slide latch assembly to retain the central portion of the slide bar and to act as a means for mounting the socket attachment for the crank. The socket attachment was connected to a pinion which engaged a rack formed in the middle of the slide bar.

These conventional designs for slide latch assemblies thus comprised at least five separate pieces in addition to the crank attachment and gear. A base and a slide bar were separately formed and then at least three additional channel members were separately formed and subsequently attached to the base to form the finished assembly. The fabrication of the separate channel members and the subsequent assembly and attachment resulted in a slide latch assembly which was time-consuming and expensive to produce.

In addition, prior slide latch assemblies were sometimes difficult to engage, particularly on caskets having two separate top halves. It was often difficult to engage all of the escutcheons on both halves of the top. Each top half would have to be held down separately and the slide latch assemblies were designed so that all of the escutcheons were engaged at the same time. If the crank was located at one end of the casket, it was especially difficult to make sure that the escutcheons at the far end of the casket were engaged.

SUMMARY OF THE INVENTION

The present invention provides the slide latch assembly for a casket which offers advantages in manufacture and operation not offered heretofore. The slide latch assembly of the present invention eliminates the necessity of forming separate channel members and attaching these channel members to the base, thereby eliminating costly and time-consuming steps in the manufacture of these assemblies. In accordance with the present invention, the slide bar is supported from the base by a plurality of U-shaped retraining guide members which are integrally formed from the base. The guide members are preferably formed by being cut or stamped from the longitudinally elongated base strip and then bent downwardly so that they extend perpendicularly from the base. Each of the guide members is stamped or cut with a slot therein through which the slide bar extends. These guide members may be stamped at the same time that the base is formed so that the separate step of making the channel members is eliminated. In addition, since the guide members are integrally formed from the base, they need not be attached to the base in a subsequent operation, and thus the step of attaching the channel members to the base of the prior slide latch assemblies is eliminated.

The present invention also provides an improved slide latch assembly in which the escutcheons at one end are engaged before the escutcheons at the other end. The portions of the slide bar which secure the escutcheons are designed differently, so that the securing portions at the end farthest from the crank engage the escutcheons before the other securing portions do. This assures that the slide bar will first capture the escutcheons at the far end, which are usually more difficult to engage, before the bar is moved to engage and lock all of the escutcheons. This feature offers particular advantages in slide latch assemblies intended for use with caskets having two top halves, and eliminates the problems of engaging the escutcheons on both casket top halves at the same time.

These and other advantages are provided by the present invention of a slide latch assembly for a casket which comprises a base formed of a longitudinally elongated strip of sheet metal material. A slide bar extends longitudinally along and perpendicularly to the base. The slide bar has securing portions spaced thereon and has a gear-engaging portion connected with the bar. Preferably, the securing portions comprise a wedge-shaped component adapted to secure an escutcheon, and some of the securing portions have an initial engaging component extending from the wedge-shaped component for engaging an escutcheon before others of the securing portions engage an escutcheon. Means are provided on the base for supporting the slide bar. The supporting means preferably comprises a plurality of U-shaped restraining guide members integrally formed form the base by being stamped out therefrom and bent to extend perpendicularly to the base. Each of the guide members has a slot therein, and the slide bar is inserted through the slots in the guide members and is freely movable therein in a longitudinal direction. Means are provided for moving the slide bar, the moving means comprising a gear means engaging the gear-engaging portion of the slide bar and a handle attachment connected to the gear. A support is mounted on the base for the moving means.

DETAILED DESCRIPTION OF THE PREFERRED EMBODIMENT

Figures 1, 2, 3, 4:
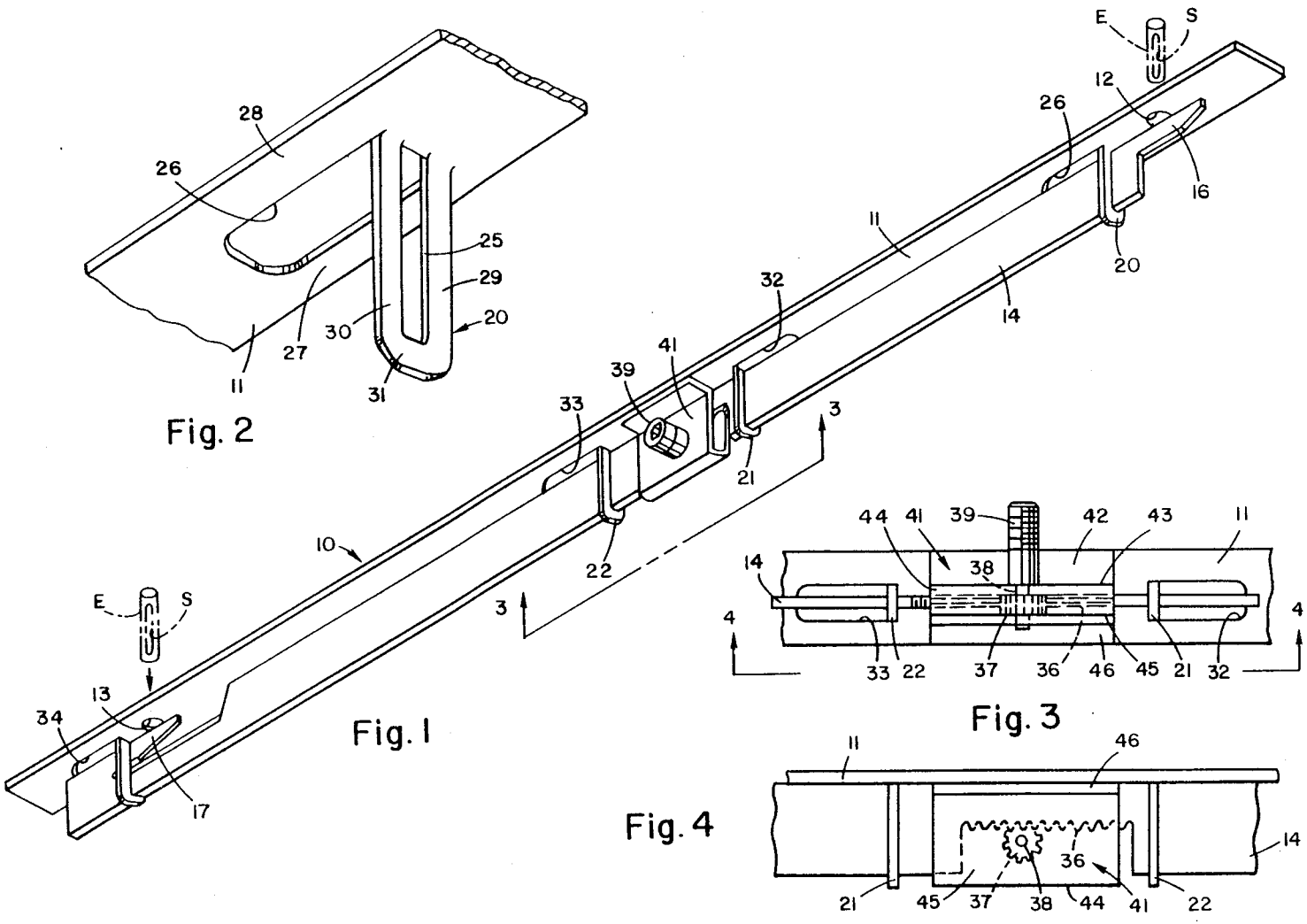
FIG. 1 is a perspective view of the slide latch assembly of one embodiment of the present invention.
FIG. 2 is a detailed, perspective view of a portion of the slide latch assembly of FIG. 1 showing a portion of the base and one of the integrally formed guide members.
FIG. 3 is a bottom plan view of the central portion of the slide latch assembly taken from line 3—3 of FIG. 1, showing the engagement of the rack and the pinion.
FIG. 4 is a rear side elevational view of the portion of the slide latch assembly taken from line 4—4 of FIG. 3.

Referring more particularly to the drawings and initially to FIG. 1, there is shown the slide latch assembly 10 of one embodiment of the present invention. The assembly 10 includes an upper supporting base 11 which is formed of a longitudinally elongated strip of sheet metal material. The base 10 may be, for example, approximately one inch wide and approximately three or six feed long. Near each of its ends, the base 11 has circular holes 12 and 13, two such holes being shown in the embodiment of FIG. 1. When the slide latch assembly 10 is mounted beneath the rim on the lower portion of a casket, two escutcheons from the casket lid extend downwardly, one through each of the holes 12 and 13. These escutcheons have apertures and are secured by a slide bar 14 which extends longitudinally along the base 11 and extends perpendicularly to the base. The slide bar 14 is also formed of a sheet metal material, typically thicker than that used to form the base 11. The slide bar 14 is almost the same length as the base 11.

The slide bar 14 has wedge-shaped securing portions 16 and 17, each of which engages one of the escutcheons E which extends through one of the holes 12 and 13. In the slide latch assembly 10 of FIG. 1, the slide bar 14 has two securing portions 16 and 17. The securing portion 16 comprises a portion which is narrower than the rest of the slide bar 14 and has a ramp or camming component at the end which initially engages the opening or slot S in the escutcheon E. As the slide bar 14 moves longitudinally, the escutcheon E is pulled through the hole 12 and away from the base 11 by the camming or wedging action of the portion 16. The other securing portion 17 shown on the opposite end of the slide bar 14 operates in a similar manner. The securing portion 17 operates in the same direction as the securing portion 16 and is connected to the remainder of the slide bar 14 so that this end of the slide bar forms a hook-shaped portion to allow the escutcheon to extend through the hole 12 without interference from the remainder of the slide bar.

The slide latch assembly 10 shown in FIG. 1 is adapted to secure two escutcheons E, so that it has two holes 12 and 13 and two securing portions 16 and 17. Other slide latch assemblies may be adapted to secure a larger number of escutcheons, typically four escutcheons, and these assemblies would be provided with additional holes and securing portions as necessary.

With the design of slide latch assemblies of the prior art, the slide bar was supported from the base by means of a plurality of channel members which were separately formed and secured to the base. In accordance with the present invention, however, the slide bar 14 is supported from the base 11 by a plurality of flat U-shaped restraining guide members 20, 21, 22, and 23. Each of the guide members 20–23 is essentially the same, and all will be described with reference to the guide member 20, which is shown in greater detail in FIG. 2. The guide member 20 comprises a U-shaped portion which is cut or stamped from the base 11 and is bent to extend perpendicularly downwardly from the base. When the guide member 20 is cut from the base 11, an elongated slot 25 is also cut or stamped. The slot 25 is of approximately the same dimension as, but slightly larger than, the cross section of the slide bar 14, so that the slide bar may fit within the slot 25 and is freely movable longitudinally therein.

The guide member 20 may be formed in accordance with stamping and bending methods known in the sheet metal fabricating art. When the guide member 20 is formed, an opening 26 is left in the base 11. Strip portions 27 and 28 remain on each side of the opening 26 so that any structural weakening of the base 11 is avoided. The guide member 20 is dimensioned with side portions 29 and 30 which are sufficiently wide to retain the slide bar 14 and prevent any lateral movement of the slide bar, while leaving a sufficient amount of the base remaining to form the strip portions 27 and 28, which are wide enough so that the base 11 maintains the necessary strength. The guide member 20 is also formed with an end portion 31 which is sufficiently wide to support the slide bar 14 and to prevent movement of the slide bar 14 away from the base. Other openings 32, 33, and 34, each of which is similar to the opening 26, are formed in the base 11 by the other guide members 21, 22, and 23, respectively.

The slide bar 14 is moved longitudinally by moving means. In the embodiment of the invention shown in FIGS. 1–4, the moving means includes a rack 36 formed in the central portion of the slide bar 14 and a pinion 37 engaging the rack 36. This portion of the slide latch assembly is shown in greater detail in FIGS. 3 and 4. As the pinion 37 engages the rack 36, rotation of the pinion causes the slide bar 14 to be moved longitudinally. The pinion 37 is mounted on a shaft 38 which is connected to a handle attachment or socket 39. The end of a handle or crank or some other means may be inserted into the socket 39 to rotate the socket, turn the pinion 37 and thus move the slide bar 14. The pinion 37 and socket 39 are attached to the base 11 by a U-shaped support member 41. The support member 41 comprises a portion 42 which extends along one side of the base 11 and is suitably attached to the base by spot welding, brazing, or other means, a portion 43 which extends downwardly perpendicularly to the base and to the portion 42, a bottom portion 44 which extends beneath the slide bar 14, a portion 45 extending parallel to the portion 43 on the other side of the slide bar, and a portion 46 which is also suitably attached to the base 11 on the other side from which the portion 42 is attached. The portions 43 and 45 of the support member 41 have small openings through which the shaft 38 extends. The pinion 37 is then mounted between the portion 43 and the portion 45, and the socket 39 is mounted on the other side of the portion 43. The pinion and socket assembly is thus held rigidly in place and is supported from the base with the pinion 37 engaging the rack 36 on the slide bar.

In previous slide latch assembly designs, the support for the means for moving the slide bar also served as a support for the slide bar. It was therefore important that the U-shaped member be of the proper dimensions to securely support the slide bar. In the present invention, the two guide members 21 and 22 support the slide bar 14, so that the support member 41 need not hold the slide bar, and it can be made with greater tolerance.

While four guide members 20–23 are shown in the embodiment of the invention of FIG. 1, it is understood that fewer or more guide members may be provided depending upon the length of the slide latch assembly, the gauge of thickness of the material used to form the base and the guide members, the stiffness of the slide bar, the number of escutcheons being secured, the number and spacing of the securing portions provided on the slide bar, and other factors. While the support member 41 is shown in approximately the middle of the slide latch assembly, it is understood that the support member for the moving means may be placed anywhere along the slide latch assembly depending upon the configuration of the assembly. The guide members may also be suitably placed at various locations on the base depending upon the configuration of the assembly.

Figures 5, 6, 7, 8, 9:
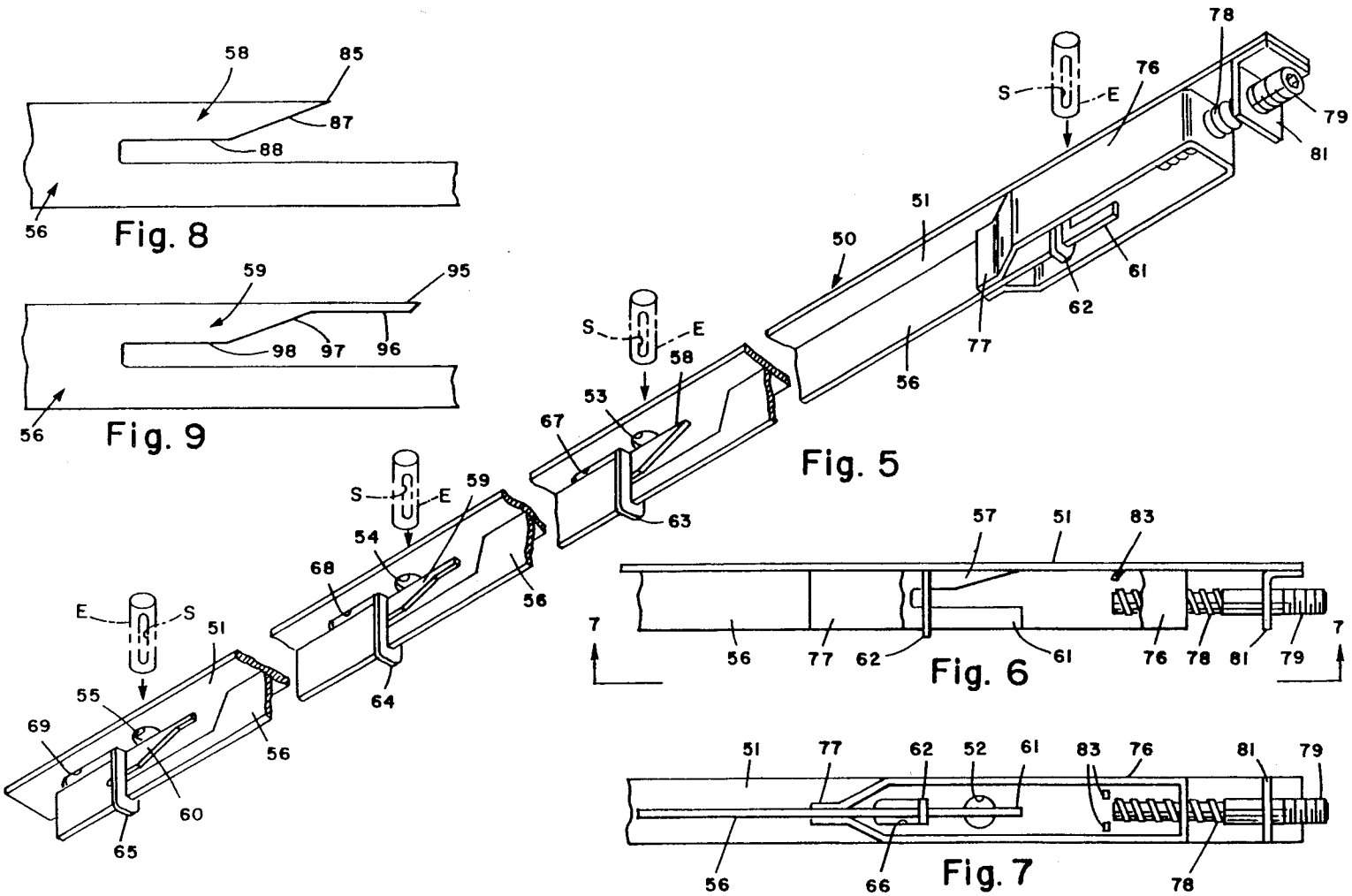
FIG. 5 is a perspective view of another slide latch assembly comprising a second embodiment of the present invention.
FIG. 6 is a side elevational view of the end portion of the slide latch assembly of FIG. 5 showing the engagement of the threaded gear and the collar.
FIG. 7 is a bottom plan view of the portion of the slide latch assembly taken from line 7—7 of FIG. 6.
FIG. 8 is a side elevational view of one of the securing portions of the slide bar of FIG. 5.
FIG. 9 is a side elevational view similar to FIG. 8 of another of the securing portions of the slide bar of FIG. 5.

While the moving means shown in the embodiment of the invention of FIG. 1 comprises a rack and pinion assembly, other moving means are possible. For example, FIGS. 5–7 show a slide latch assembly 50 which uses a different moving means. The assembly 50 includes an upper supporting base 51 which is essentially similar to the base 11. The assembly 50, like the assembly 10, is mounted beneath the rim on the lower portion of the casket. The assembly 50 shown in FIG. 5 is typically about six to seven feet long, but it may be of any suitable length according to the casket upon which it is used. Escutcheons E from the casket top extend downwardly through holes 52, 53, 54, and 55 in the base 51. Typically, four escutcheons E will be provided, and at least four corresponding holes 52, 53, 54, and 55 will be positioned in the base 51. The escutcheons E are secured by a slide bar 56 which extends longitudinally beneath the base 51. The slide bar 56 has a plurality of wedge-shaped securing portions 57, 58, 59 and 60, one adjacent to each of the holes 52–55. Each securing portion 57–60 engages the opening or slot S in one of the escutcheons which extends through one of the holes 52–55. With the ramp or camming action of the securing portion 57–60, the escutcheon E is pulled through the holes 52–55 as the slide bar 56 moves longitudinally. The end securing portion 56 includes a lower longitudinally extending end portion 61 so that this end of the slide bar 56 remains in place, supported by the guide member 62.

The slide bar 56 is supported from the base 51 by a plurality of flat U-shaped restraining guide members 62, 63, 64, and 65, each of which is similar to the guide member 20 of FIG. 2. Each guide member 62–65 is stamped from the base 51 and bent downwardly, leaving an opening 66–69 in the base. The number and position of each guide member 62–65 depends upon the configuration of the slide latch assembly. Usually a guide member 62–65 will be provided adjacent to each hole 52–55.

The slide bar 56 is moved longitudinally by moving means which include a collar 76 attached at one end of the slide bar 56 (FIGS. 5–7). The collar 76 is attached to the slide bar 56 at a point 77 toward the center of the assembly away from the end securing portion 57 and guide member 62. The collar 76 branches in a Y-shape toward the slides of the base 51 and extends along each side of the base around the hole 52 and the guide member 62, the collar 76 having a width approximately equal to that of the base 51. The end of the collar 76 has a hole for engagement by a threaded gear or screw 78. The end of the screw 78 is connected to a socket 79 which extends longitudinally beneath the base 51 from one end of the assembly 50. The socket 79 is attached to the base 51 by an L-shaped support member 81. The support member 81 includes a portion which extends along the base and is suitably attached to the base by spot-welding, brazing, or other means and a portion which extends perpendicularly to the base and has an opening through which the socket 79 extends. The end of a handle or crank, or some other means, may be inserted into the socket 79 to rotate the socket, turn the threaded gear 78, and thus move the collar 76 along the axis of the screw 78. As the collar 76 moves, it moves the attached slide bar 56. Preferably, stops 83 are formed in the base 51 to engage the end of the collar 76 and limit movement by the collar in a direction away from the support member 81.

In order to capture and secure all of the escutcheons, the securing portions 57–60 provided in the slide bar 56 are shaped differently, as shown by a comparison of FIGS. 8 and 9. FIG. 8 shows the configuration of the securing portions 57 and 58 located nearest to the crank socket 79, and FIG. 9 shows the configuration of the securing portions 59 and 60 located farthest from the crank socket. In FIG. 8, the securing portion 58, which is identical to the securing portion 57, has a point or edge 85 which engages the opening S in one of the escutcheons E as the slide bar 56 moves longitudinally. A ramp or wedge component 87 extends from the edge 85 to a level locking component 88. After the edge 85 engages the opening in the escutcheon, the engagement of the wedge component 87 continues to pull the escutcheon E downwardly. Thereafter, the escutcheon E is held in a locked position by engagement with the locking component 88. In FIG. 9, the securing portion 59, which is identical to the securing portion 60, also has a forward edge 95 which engages the opening S in one of the escutcheons E, but the edge 95 extends further forward, and the securing portion has an initial engaging component 96 extending from the edge 95. The engaging component 96 extends to a ramp or wedge component 97, which continues to a level locking component 98. After the edge 95 has engaged the opening S in the escutcheon E, the engaging component 96 holds the escutcheon in the securing portion 59 until it eventually is pulled downwardly by the wedge component 87. Thereafter, the escutcheon E is held in a locked position by engagement with the locking component.

While the preferred form of this invention has been specifically illustrated and described herein, it will be apparent to those skilled in the art that modifications and improvements may be made to the form herein specifically disclosed. Accordingly, the present invention is not to be limited to the form herein specifically disclosed nor in any other way inconsistent with the progress in the art promoted by this invention.

What is claimed:

1. A slide latch assembly for a casket, which comprises:

a base formed of a longitudinally elongated strip of sheet metal material;

a slide bar extending longitudinally beneath and perpendicularly to the base, the slide bar having wedge-shaped securing portions at each end and having a rack portion near the middle of the bar;

means on the base for holding the slide bar, the holding means comprising four U-shaped restraining guide members integrally formed from the base by being stamped therefrom and bent downwardly to extend perpendicularly from the base, each of the guide members having a slot therein which is approximately the same as and slightly larger than the cross-sectional shape of the slide bar, the slide bar being inserted through the slots in the guide members and being freely movable therein in a longitudinal direction;

means for moving the slide bar comprising a pinion engaging the rack portion, a shaft connected to the pinion, and a handle attachment connected to the pinion by the shaft; and a support for the moving means comprising a U-shaped member extending beneath the slide bar and connected at each end to the base on each side of the slide bar at approximately the middle of the base and extending perpendicularly from the base and having an opening in which the shaft is mounted.

2. A slide latch assembly for a casket, which comprises:

a base formed of a longitudinally elongated strip of sheet metal material;

a slide bar extending longitudinally beneath and perpendicularly to the base, the slide bar having securing portions at each end and spaced along the slide bar for engaging and securing escutcheons and having a collar at one end having an opening at the end thereof, each of the securing portions having a wedge-shaped component and some of the securing portions having an initially engaging component extending from the wedge-shaped component for engaging an escutcheon before other of the securing portions;

means on the base for holding the slide bar, the holding means comprising U-shaped restraining guide members integrally formed from the base by being stamped therefrom and bent downwardly to extend perpendicularly from the base, each of the guide members having a slot therein which is approximately the same as and slightly larger than the cross-sectional shape of the slide bar, the slide bar being inserted through the slots in the guide members and being freely movable therein in a longitudinal direction;

means for moving the slide bar longitudinally within the guide members to allow the securing portions to engage escutcheons, the moving means comprising a threaded gear extending longitudinally with respect to the base, and a handle attachment connected to the threaded gear and extending axially therefrom; and a support for the moving means comprising an L-shaped member at one end of the slide bar and connected to the base at the end of the base and extending perpendicularly from the base and having an opening through which the handle attachment is mounted.

3. A slide latch assembly for a casket, which comprises:

a base formed of a longitudinally elongated strip of sheet metal material;

a slide bar extending longitudinally along and perpendicularly to the base, the slide bar having securing portions spaced thereon and having a gear-engaging portion comprising a collar attached to one end of the slide bar;

means on the base for supporting the slide bar, the supporting means comprising a plurality of U-shaped restraining guide members integrally formed from the base by being stamped out therefrom and bent to extend perpendicularly to the base, each of the guide members having a slot therein, the slide bar being inserted through the slots in the guide members and being freely movable therein in a longitudinal direction;

means for moving the slide bar comprising a threaded gear engaging the gear-engaging portion of the slide bar and a handle attachment connected to the gear, the threaded gear extending longitudinally from one end of the assembly and engaging the collar; and a support for the moving means.

4. A slide latch assembly for a casket, which comprises:

a base formed of a longitudinally elongated strip of sheet metal material;

a slide bar extending longitudinally along and perpendicularly to the base, the slide bar having a plurality of securing portions spaced thereon each comprising a wedge-shaped component for securing an escutcheon, some of the securing portions having an initial engaging component extending from the wedge-shaped component for engaging an escutcheon before other of the securing portions engage an escutcheon, the slide bar also having a gear-engaging portion comprising a collar attached to one end of the slide bar;

means on the base for supporting the slide bar, the supporting means allowing the slide bar to be freely movable in a longitudinal direction;

means for moving the slide bar comprising a threaded gear engaging the gear-engaging portion of the slide bar and a handle attachment connected to the gear, the threaded gear extending lontitudinally from one end of the assembly and engaging the collar; and a support for the moving means.

5. A slide latch assembly as defined in claim 3, wherein each of the securing portions comprises a wedge-shaped component adapted to secure an escutcheon.

6. A slide latch assembly as defined in claim 5, wherein some of the securing portions have an initial engaging component extending from the wedge-shaped component for engaging an escutcheon before other of the securing portions engage an escutcheon.

7. A slide latch assembly as defined in claim 4, wherein the supporting means comprises a plurality of U-shaped restraining guide members integrally formed from the base by being stamped out therefrom and bent to extend perpendicularly to the base, each of the guide members having a slot therein, the slide bar being inserted through the slots in the guide members.

8. The slide latch assembly as defined in claim 3 or 4, wherein the support comprises a member attached to the base and extending perpendicularly therefrom and having an opening in which the handle attachment is mounted.

9. A slide latch assembly as defined in claim 3 or 7, wherein there are four restraining guide members longitudinally spaced along the base.

* * * * *

UNITED STATES PATENT AND TRADEMARK OFFICE

CERTIFICATE OF CORRECTION

PATENT NO. : 4,486,040

DATED : December 4, 1984

INVENTOR(S) : William J. Strangward

It is certified that error appears in the above--identified patent and that said Letters Patent is hereby corrected as shown below:

IN THE ABSTRACT:

Line 2, "on" should be --of--.

Column 3, line 39, "feed" should be --feet--.

Signed and Sealed this

*Twenty-eighth* Day of *May 1985*

[SEAL]

*Attest:*

DONALD J. QUIGG

*Attesting Officer* *Acting Commissioner of Patents and Trademarks*